US007784898B2

(12) United States Patent
Kanda

(10) Patent No.: US 7,784,898 B2
(45) Date of Patent: Aug. 31, 2010

(54) INK JET RECORDING APPARATUS AND CONTROL METHOD

(75) Inventor: Hidehiko Kanda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 418 days.

(21) Appl. No.: 11/971,030

(22) Filed: Jan. 8, 2008

(65) Prior Publication Data

US 2008/0278524 A1 Nov. 13, 2008

(30) Foreign Application Priority Data

Jan. 18, 2007 (JP) ..... 2007-009583

(51) Int. Cl.
*B41J 2/165* (2006.01)

(52) U.S. Cl. ..... 347/23; 347/30

(58) Field of Classification Search ..... 347/6, 347/7, 23, 30
See application file for complete search history.

(56) References Cited

U.S. PATENT DOCUMENTS

2003/0112286 A1* 6/2003 Shindo ..... 347/30

FOREIGN PATENT DOCUMENTS

JP 09-277560 A 10/1997

* cited by examiner

*Primary Examiner*—Uyen-Chau N Le
*Assistant Examiner*—Kajli Prince
(74) *Attorney, Agent, or Firm*—Canon U.S.A., Inc., IP Division

(57) ABSTRACT

An ink jet recording apparatus includes a recording head having a plurality of discharge ports for discharging ink supplied from an ink tank and a plurality of heating elements. The ink jet recording apparatus further includes a detection unit configured to detect a remaining amount of ink in the ink tank, and a preliminary discharge unit configured to discharge ink from the discharge ports, unrelated to recording, by applying energy to the heating elements for recovering the recording head. The ink jet recording apparatus performs control so that when the remaining amount of ink detected is less than a predesignated remaining amount of ink, energy applied to the heating elements per unit time by the preliminary discharge unit is smaller as compared with energy applied to the heating elements per unit time when the remaining amount of ink is more than or equal to the predesignated remaining amount of ink.

8 Claims, 18 Drawing Sheets

FIG. 4

| | DRIVING FREQUENCY | DISCHARGE PORT POSITION | NUMBER OF INPUT PULSES |
|---|---|---|---|
| PARAMETER A1 | 15kHz | 1～192 | 4000 |
| PARAMETER B1 | 15kHz | 1～192 | 8000 |

FIG. 6

| | DRIVING FREQUENCY | DISCHARGE PORT POSITION | NUMBER OF INPUT PULSES |
|---|---|---|---|
| PARAMETER A2 | 7.5kHz | 1～192 | 4000 |
| PARAMETER B2 | 5kHz | 1～192 | 8000 |

FIG. 9

| | DRIVING FREQUENCY | DISCHARGE PORT POSITION | NUMBER OF INPUT PULSES |
|---|---|---|---|
| PARAMETER A3 | 15kHz | 2 GROUPS: 1-96/97-192 | EACH 4000 |
| PARAMETER B3 | 15kHz | 3 GROUPS: 1-64/65-128/129-192 | EACH 8000 |

FIG. 13

| | DRIVING FREQUENCY | DISCHARGE PORT POSITION | NUMBER OF INPUT PULSES |
|---|---|---|---|
| PARAMETER A | 15kHz | 0.7μsec | EACH 8000 |
| PARAMETER B | 15kHz | 0.7μsec | EACH 16000 |

FIG. 15

| | DRIVING FREQUENCY | DISCHARGE PORT POSITION | NUMBER OF INPUT PULSES |
|---|---|---|---|
| PARAMETER A | 15kHz | 20 (V) | EACH 8000 |
| PARAMETER B | 15kHz | 20 (V) | EACH 16000 |

INK JET RECORDING APPARATUS AND CONTROL METHOD

BACKGROUND OF THE INVENTION

1. Field of the Invention

The present invention relates to an ink jet recording apparatus which discharges inks to a recording medium to execute recording, and more particularly to a preliminary discharge control technology.

2. Description of the Related Art

There is a recording apparatus which includes functions of a printer, a copying machine, and a facsimile, or a recording apparatus which is used as an output device for a complex electronic device including a computer and a word processor, or a work station. Such a recording apparatus is configured to record images (including characters) on a recording medium such as a sheet or a plastic sheet based on image information (including character information). With respect to a recording method, the recording apparatus can be classified into an ink jet type, a wire dot type, a thermal type, a laser beam type and the like. Among such recording types, the recording apparatus of the ink jet type (i.e., ink jet recording apparatus) discharges inks from a recording unit (i.e., recording head) to a recording medium to perform recording. As compared with the other recording types, the ink jet recording apparatus has advantages in that high definition can be achieved more easily and the apparatus can be operated silently and at a higher speed. Moreover, its selling price has decreased in recent years. To increase a recording speed, the ink jet recording apparatus uses a recording head integrating a plurality of ink discharge ports as ink discharge portions and a plurality of liquid paths for a recording head in which a plurality of recording elements is integrated and arrayed. The ink jet recording apparatus generally includes a plurality of recording heads to make a color print.

When no recording is performed, the recording apparatus stands by in a home position of the recording head while the discharge ports of the recording head is covered with a cap to suppress ink evaporation. If this stand-by state of no recording continues for a long time, the ink evaporates gradually from the discharge port which causes thickening of ink, resulting in an increase in ink concentration, or defective discharge. To reduce such an effect, preliminary discharge that is not used for recording, or suction of ink from the discharge ports is carried out as recovery work of the recording head before starting recording, in order to remove thickened inks. For example, Japanese Patent Application laid-Open No. 3531347 discusses a configuration for calculating ink viscosity based on a remaining amount of ink so that preliminary discharge conditions can be changed.

Furthermore, a wiping operation can be performed to remove inks stuck on a face of the recording head where the discharge ports are arranged side by side. The sticking of ink is caused by spattering of the inks from the recording medium during a recording operation. After suction is completed, a wiping operation is carried out to remove inks stuck on the face of the recording head where the discharge ports are arranged side by side. Preliminary discharge that is not used for recording is carried out in the wiping operation to remove inks pushed into the discharge ports. Moreover, when inks of a plurality of different colors are sucked by the same cap, mixed color inks generated in the cap which has sucked the inks, enter the discharge ports. To remove the mixed color inks which have entered the discharge ports, preliminary discharge that is not used for recording is carried out after the suction is completed.

When discharge systems are operated in the ink jet recording apparatus, the discharge is accompanied by heat of some kind. There is a case where the heat is generated to discharge inks, in other words, inks are discharged using heat energy. A representative example of an ink jet recording apparatus which operates based on ink discharge using heat energy is a recording apparatus in which bubbles are rapidly generated by film boiling to discharge inks. The film boiling occurs in inks due to heat energy generated by a heating element serving as a discharge energy generation element. As a discharge system which incidentally generates heat, as discussed in Japanese Patent Application Laid-Open No. 3531347, for example, a system that uses a well-known piezoelectric element as discharge energy generation element is available. According to this system, heat is indirectly generated due to vibration of the piezoelectric element although no direct heat is generated to discharge inks.

However, in the ink jet recording apparatus, in order to achieve higher image quality and a higher speed, the amount of each discharge is reduced to increase a recording pixel density, or the longer recording head is utilized to increase the number of discharge ports. As a result, heat energy applied to the recording head during the preliminary discharge operation is increased, which can cause an increase in temperature of the recording head.

Further, if a heat sink disposed in the recording head is removed to reduce its manufacturing cost, a temperature of the recording head can be further increased. When there is enough ink in an ink tank for recording, ink is supplied adequately to the recording head. In such a case, heat applied to the recording head for preliminary discharge is discharged to the outside together with the discharged ink. However, when a remaining amount of ink in the ink tank becomes small or ink runs short, heat cannot be effectively discharged from the recording head when preliminary discharge is executed in a state that the ink used for recording is insufficient. Thus, a temperature of the recording head may increase more rapidly. As a result, a function for protecting the recording head and a recording operation can be restrained, against user's intension.

SUMMARY OF THE INVENTION

An embodiment of the present invention is directed to a technology of reducing frequency of a function which operates to protect a recording head against the heat caused by preliminary discharge.

According to an aspect of the present invention, an embodiment is directed to an ink jet recording apparatus for discharging ink from a recording head to a recording medium to execute recording. The ink jet recording apparatus includes the recording head having a plurality of discharge ports for discharging ink supplied from an ink tank, and a plurality of heating elements, each heating element provided for each of the discharge ports, an detection unit configured to detect a remaining amount of ink in the ink tank, a preliminary discharge unit configured to discharge ink from the discharge ports, unrelated to recording, by applying energy to the heating elements to recover the recording head, and a control unit configured to perform control, so that when the remaining amount of ink detected by the detection unit is less than a predesignated remaining amount of ink, energy applied to the heating elements per unit time by the preliminary discharge unit is smaller as compared with energy applied to the heating elements per unit time when the remaining amount of ink is more than or equal to the predesignated remaining amount of ink.

According to another aspect of the present invention, an embodiment is directed to an ink jet recording apparatus for discharging inks from a plurality of recording heads to a recording medium to execute recording. Each of the recording heads includes a plurality of discharge ports for discharging ink supplied from an ink tank, and a plurality of heating elements, each heating element provided for each of the discharge ports. The ink jet recording apparatus includes a detection unit configured to detect a remaining amount of ink in each of the ink tanks corresponding to the plurality of recording heads, a preliminary discharge unit configured to discharge ink from the discharge ports of the plurality of recording heads, unrelated to recording, by applying energy to the heating elements of the plurality of recording heads to recover the plurality of recording heads, a determination unit configured to determine a recording head which is not used for recording, among the plurality of recording heads, and a control unit configured to perform control, so that at least when the remaining amount of ink detected by the detection unit corresponding to the recording head determined not to be used for the recording by the determination unit is less than a predesignated remaining amount of ink, energy applied per unit time by the preliminary discharge unit to the recording head is smaller as compared with energy applied per unit time when the remaining amount of ink is more than or equal to the predesignated remaining amount of ink.

According to yet another aspect of the present invention, an embodiment is directed to a method for controlling an ink jet recording apparatus which includes a recording head having a plurality of discharge ports for discharging ink supplied from an ink tank, and a plurality of heating elements, each heating element provided for each of the discharge ports. The ink jet recording apparatus is operable to discharge ink from the recording head to a recording medium to execute recording. The method includes detecting a remaining amount of ink in the ink tank, executing preliminary discharge to discharge ink from the discharge ports, unrelated to recording, by applying energy to the heating elements to recover the recording head, and performing control, so that when the detected remaining amount of ink is less than a predesignated remaining amount of ink, energy applied to the heating elements per unit time during execution of the preliminary discharge is smaller as compared with energy applied to the heating elements per unit time when the remaining amount of ink is more than or equal to the predesignated remaining amount of ink.

According to yet another aspect of the present invention, an embodiment is directed to a method for controlling an ink jet recording apparatus which includes a plurality of recording heads, each recording head having a plurality of discharge ports for discharging inks supplied from an ink tank, and a plurality of heating elements, each heating element provided for each of the discharge ports. The ink jet recording apparatus is operable to discharge ink from the plurality of recording heads to a recording medium to execute recording. The method includes detecting a remaining amount of ink in each of the ink tanks corresponding to the plurality of recording heads, executing preliminary discharge to discharge ink from the discharge ports of the plurality of recording heads, unrelated to recording, by applying energy to the heating elements of the plurality of recording heads to recover the plurality of recording heads, determining a recording head which is not used for recording, among the plurality of recording heads, and performing control, so that at least when the detected remaining amount of ink corresponding to the recording head determined not to be used for recording is less than a predesignated remaining amount of ink, energy applied per unit time during execution of the preliminary discharge to the recording head is smaller as compared with energy applied per unit time when the remaining amount of ink is more than or equal to the predesignated remaining amount of ink.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 is a table illustrating examples of parameters A1 and B1 for preliminary discharge at a normal time.

FIG. 6 is a table illustrating examples of parameters A2 and B2 for preliminary discharge when the remaining amount of ink is small according to the first exemplary embodiment.

FIG. 9 is a table illustrating examples of parameters A3 and B3 for preliminary discharge when the remaining amount of ink is small according to a second exemplary embodiment of the present invention.

FIG. 13 is a table illustrating examples of parameters A4 and B4 for preliminary discharge when the remaining amount of ink is small according to a third exemplary embodiment of the present invention.

FIG. 15 is a table illustrating examples of parameters A5 and B5 for preliminary discharge when the remaining amount of ink is small according to a fourth exemplary embodiment of the present invention.

DETAILED DESCRIPTION OF THE EMBODIMENTS

Various exemplary embodiments, features, and aspects of the invention will be described in detail below with reference to the drawings.

First Exemplary Embodiment

An ink jet recording apparatus of a first exemplary embodiment of the present invention which utilizes four-color inks will be described as an example.

Figure 1:
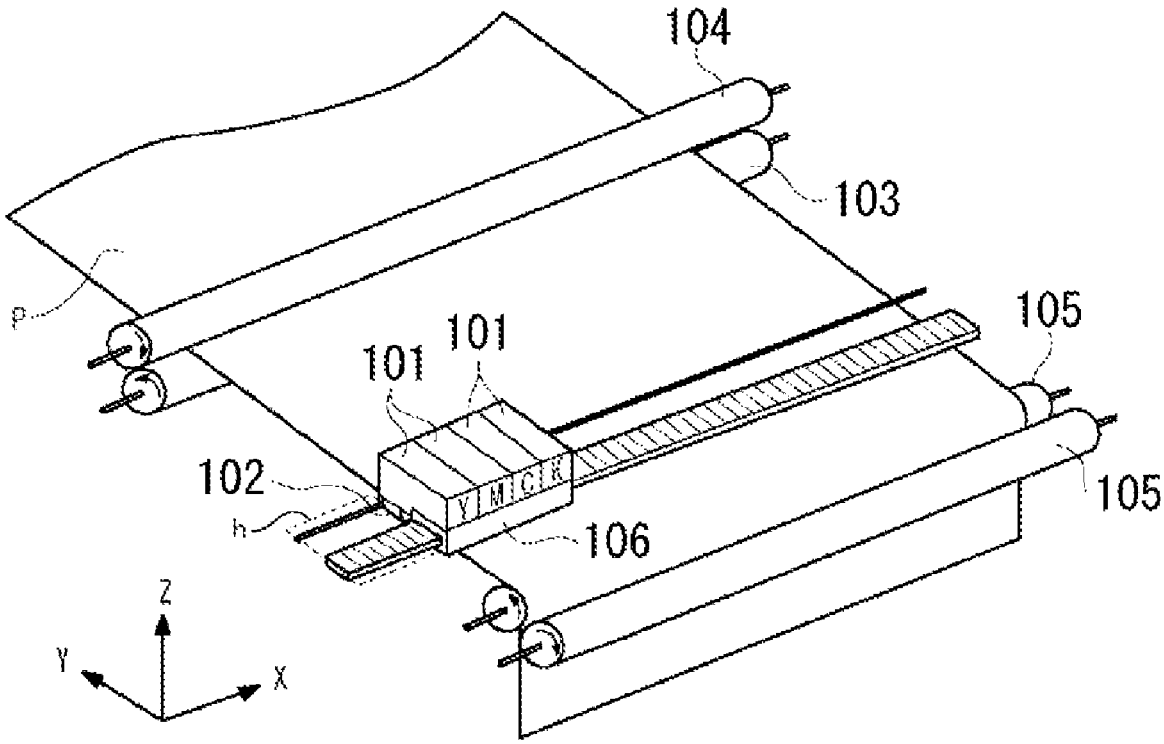
FIG. 1 is a diagram illustrating an example of a printer of an ink jet recording apparatus according to a first exemplary embodiment of the present invention.
Figure 2:
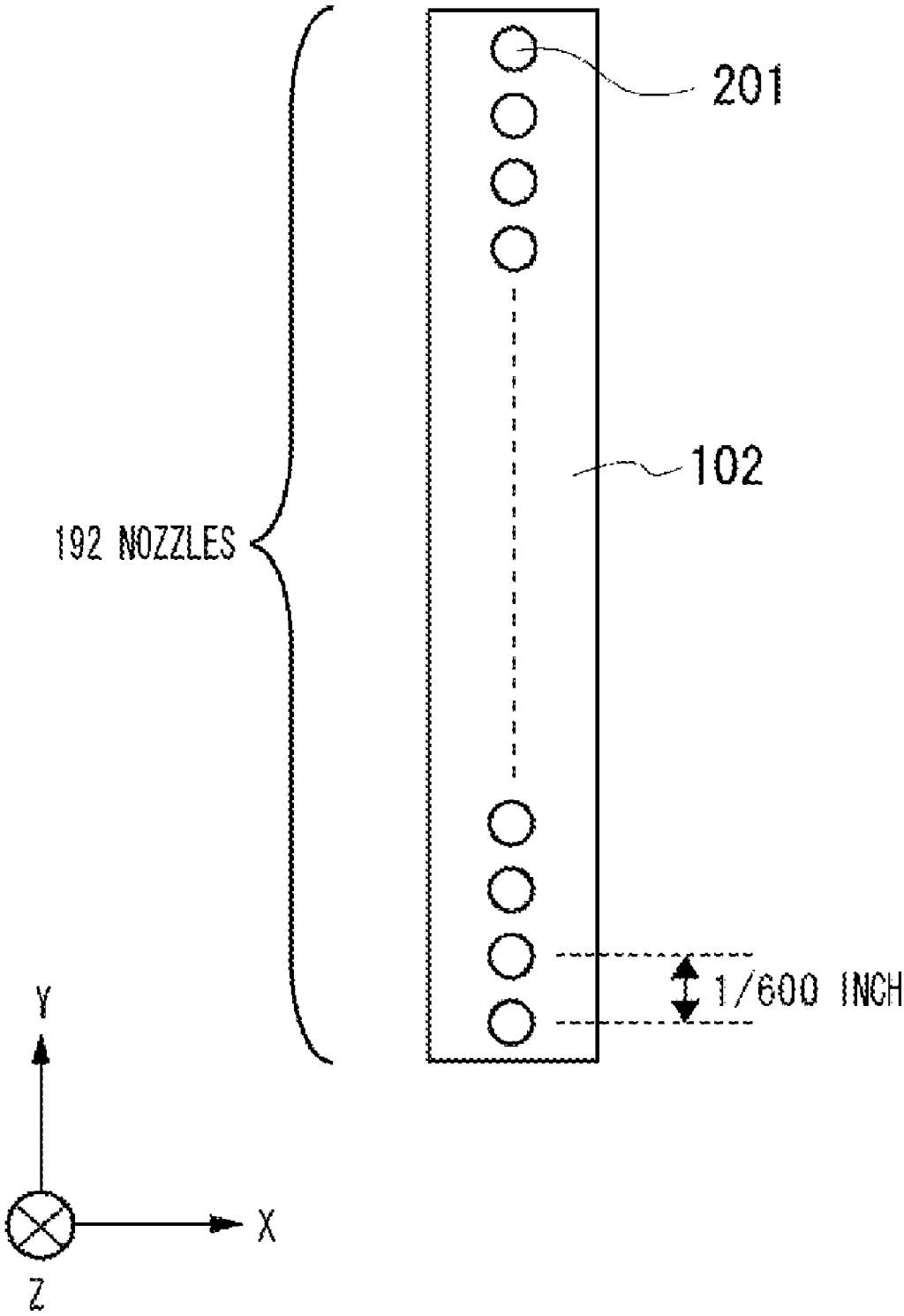
FIG. 2 is a diagram illustrating discharge ports arrayed on a recording head in a Z direction.

FIG. 1 illustrates an example of a recording head of the ink jet recording apparatus according to the first exemplary embodiment. FIG. 2 illustrates discharges ports arrayed on the recording head in a Z direction.

Ink cartridges 101 correspond to four color inks of black, cyan, magenta, and yellow. The ink cartridge 101 includes an ink tank filled with ink, and a recording head 102. A plurality of discharge ports 201 is arrayed on the recording head 102. In an embodiment, 192 discharge ports (nozzles) are arranged at intervals of 1/600 inches.

A paper feed roller 103 is rotated in a direction of an arrow of FIG. 1 while holding a recording medium P with an assist roller 104 to feed the recording medium P in a Y direction as needed. A pair of paper feed rollers 105 feeds the recording medium P while holding the recording medium P as in the case of the rollers 103 and 104. A carriage 106 is configured to support four ink cartridges 101, records data, and move the ink cartridges 101. When no recording is executed, or during recovery work of the recording head, the carriage 106 stands by in a home position (h) as indicated by a dotted line in FIG. 1.

When no recording is executed, the carriage 106 stands by in a state where the discharge ports of the recording head are covered with caps (not shown) to suppress ink evaporation though the discharge ports. If the standby state in which no recording is executed, continues for a long time, ink gradually evaporates through the discharge ports to cause ink to thicken, which results in an increase in ink concentration or discharge failures. To address this situation, a recovery operation of the recording head is carried out before starting a recording operation. More specifically, in the home position (h), energy (driving signal) is applied to heating elements disposed in the discharge ports of the recording head 102 to remove the thickened ink (preliminary discharge). Alternatively, the thickened ink is removed by suction from the discharge ports. Between recording operations, ink may be stuck on the port face where the discharge ports of the recording head are arranged side by side, due to spattering of the ink from the recording medium during recording. Ink may also be stuck on the port face after a suction operation is completed. Such stuck ink remaining after the suction operation is removed by performing a wiping operation. Then, to remove the ink pushed into the discharge ports by the wiping operation, a preliminary discharge operation which is not used for recording is carried out.

Figure 3:
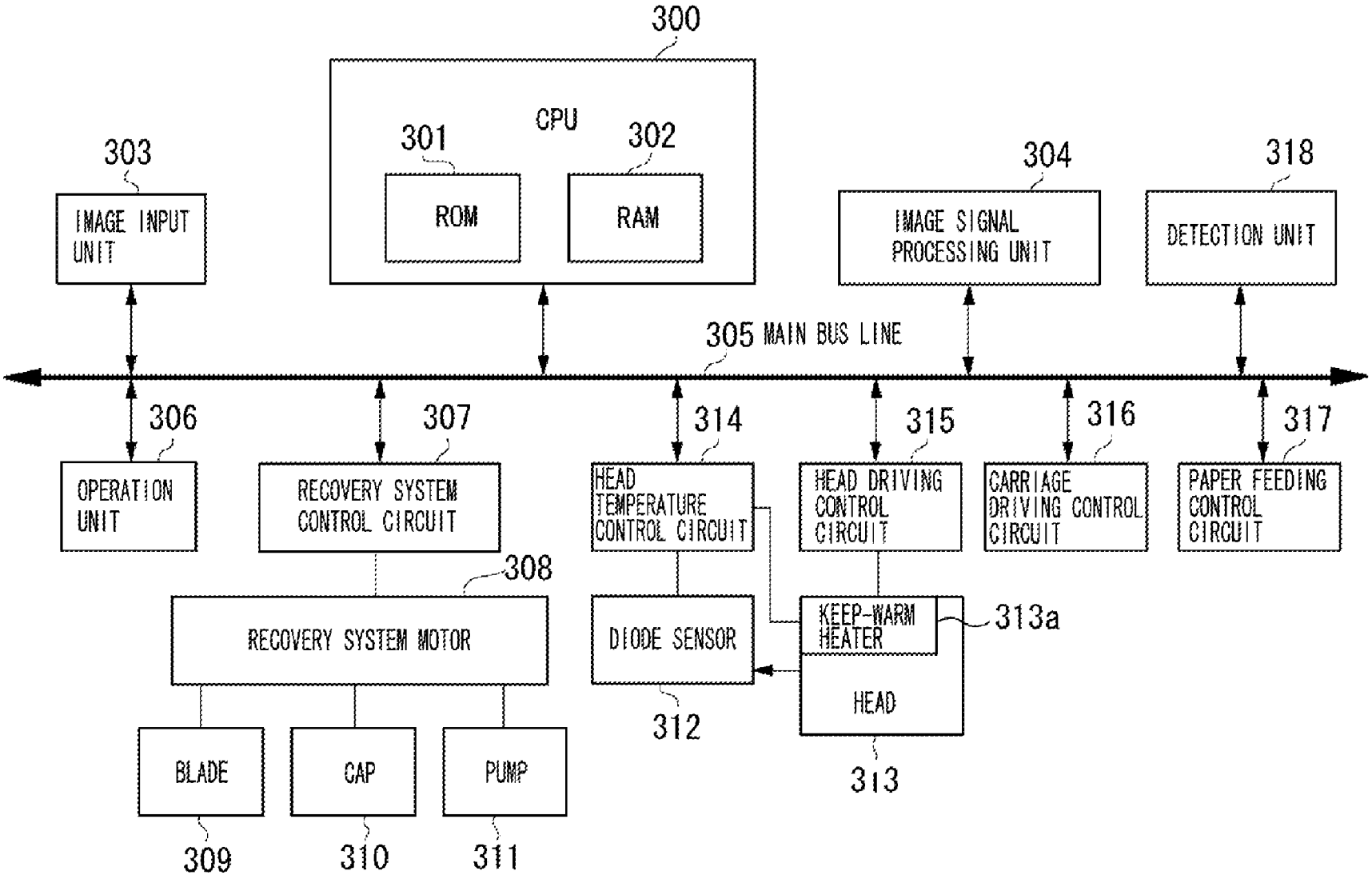
FIG. 3 is a block diagram illustrating an example of the ink jet recording apparatus according the first exemplary embodiment.

FIG. 3 is a block diagram illustrating an example of the ink jet recording apparatus according to the first exemplary embodiment.

The ink jet recording apparatus includes a software-related processing section which includes an image input unit 303, a corresponding image signal processing unit 304, and a central processing unit (CPU) 300, which respectively access a main bus line 305. Additionally, the ink jet recording apparatus includes a hardware processing section which includes an operation unit 306, a recovery system control circuit 307, a head temperature control circuit 314, a head driving control circuit 315, a carriage driving control circuit 316 in a main scanning direction, and a paper feeding control circuit 317 in a sub scanning direction.

The CPU 300 includes a read-only memory (ROM) 301 and a random access memory (RAM) 302, and drives a recording head 313 (corresponding to the recording head 102 of FIG. 1) to carry out recording by providing proper recording conditions to input information. The ROM 301 stores a program for executing a recovery timing chart of the recording head 313 before hand. The CPU 300 reads and executes the program as a control unit by providing recovery conditions such as preliminary discharge conditions to the recovery system control circuit 307, the recording head 313, and a keep-warm heating 313*a* as needed.

A recovery system motor 308 drives the recording head 313, and a cleaning blade 309, a cap 310, and a suction pump 311 which are arranged distanced from and opposing the recording head 313. The head driving control circuit 315 executes driving conditions for the heating elements of the recording head 313. By applying a pulse signal of a predetermined voltage to drive the heating elements, preliminary discharge or discharge of recording ink is carried out by the recording head 313.

The keep-warm heater 313*a* is disposed in a substrate which includes an ink discharge electro thermal converter for the recording head 313. An ink temperature in the recording head can be heated or adjusted to a preset temperature. A diode sensor 312 also disposed in the substrate measures a real ink temperature in the recording head 313. Alternatively, the diode sensor 312 may be disposed outside of the substrate, or in the vicinity around the recording head 313.

A detection unit 318 detects the remaining amount of ink in the ink tank of each color. Based on the remaining amount of ink detected by detection unit 318, the CPU 300 notifies a user via the operation unit 306 when an ink tank replacement is needed. The detection unit 318 is configured to optically detect the remaining amount of ink by using a transparent ink tank. In addition, the detection unit 318 may be configured to count the number of discharged ink droplets or the amount of consumed ink to detect the remaining amount of ink based on the amount of consumed ink.

According to the first exemplary embodiment, the ink jet recording apparatus includes four recording heads illustrated in FIG. 1, and the recording heads respectively discharge inks of black, cyan, magenta, and yellow. Each recording head is configured such that a recording pixel density is 600 dpi with the number of discharge ports=192 and intervals of the discharge ports=1/600 inches. A discharge amount from each recording head is set such that about 2 pl can be discharged per droplet. In this case, in order to stably discharge ink droplets, a driving voltage is 24 (V), a discharge pulse width is 1 μsecond, and a discharge frequency is 15 kHz. When a temperature of the recording head reaches 60° C. or more, it is determined that an abnormal increase of the temperature has occurred and the recording head protection function begins to operate. In the protection function, for example, a process is carried out to restrain a subsequent recording operation. A speed of the carriage carrying the recording heads in the main scanning direction is about 25 inches/ second in a case where ink droplets are discharged in the recording at a 600 dpi interval in the main scanning direction.

FIG. 4 illustrates examples of parameters A1 and B1 for preliminary discharge at a normal time. The preliminary discharge is presumed to be performed at the normal time when the remaining amount of ink is determined to be enough by the detection unit 318. "DISCHARGE PORT POSITION" in FIG. 4 means Y-direction positions (numbers) of the plurality of discharge ports (FIG. 2) arranged in the recording head which are processed in a preliminary discharge operation. Accordingly, in "DISCHARGE PORT POSITION=1 to 192", all the discharge ports are processed.

The preliminary discharge parameter A1 is used to perform preliminary discharge to remove thickened ink when the carriage remains in a stand-by state for a long time while the discharge ports of the recording head are covered with the caps. The parameter A1 is also used to perform preliminary discharge after completing a wiping operation to remove ink stuck on the port face due to ink spattering from the recording medium during recording. On the port surface, the discharge ports of the recording head are arranged side by side. In other words, the parameter A1 is used to remove ink pushed into the discharge port of the recording head in the wiping operation. This process is sequentially carried out in the four recording heads of black, cyan, magenta, and yellow. According to the preliminary discharge parameter A1, the CPU 300 applies discharge energy to all the heating elements corresponding to the discharge port positions 1 to 192. In other words, inks are discharged from all 192 nozzles. This process is repeated 4000 times with a driving frequency of 15 kHz. In other words, 4000 ink droplets are discharged from one discharge port. Time spent for this preliminary discharge is (4000)/(15 kHz)×4 colors=about 1.0 second.

The preliminary discharge parameter B1 is used to perform preliminary discharge to remove mixed color inks generated in a cap when four-color inks of black, cyan, magenta, and yellow are sucked by the same cap. Preliminary discharge is sequentially carried out for the four recording heads of black, cyan, magenta, and yellow. A difference from the preliminary discharge parameter A1 is that 8000 ink droplets are discharged from one discharge port. Time spent for this preliminary discharge is (8000)/(15 kHz)×4 colors=about 2.1 seconds.

Figure 5:
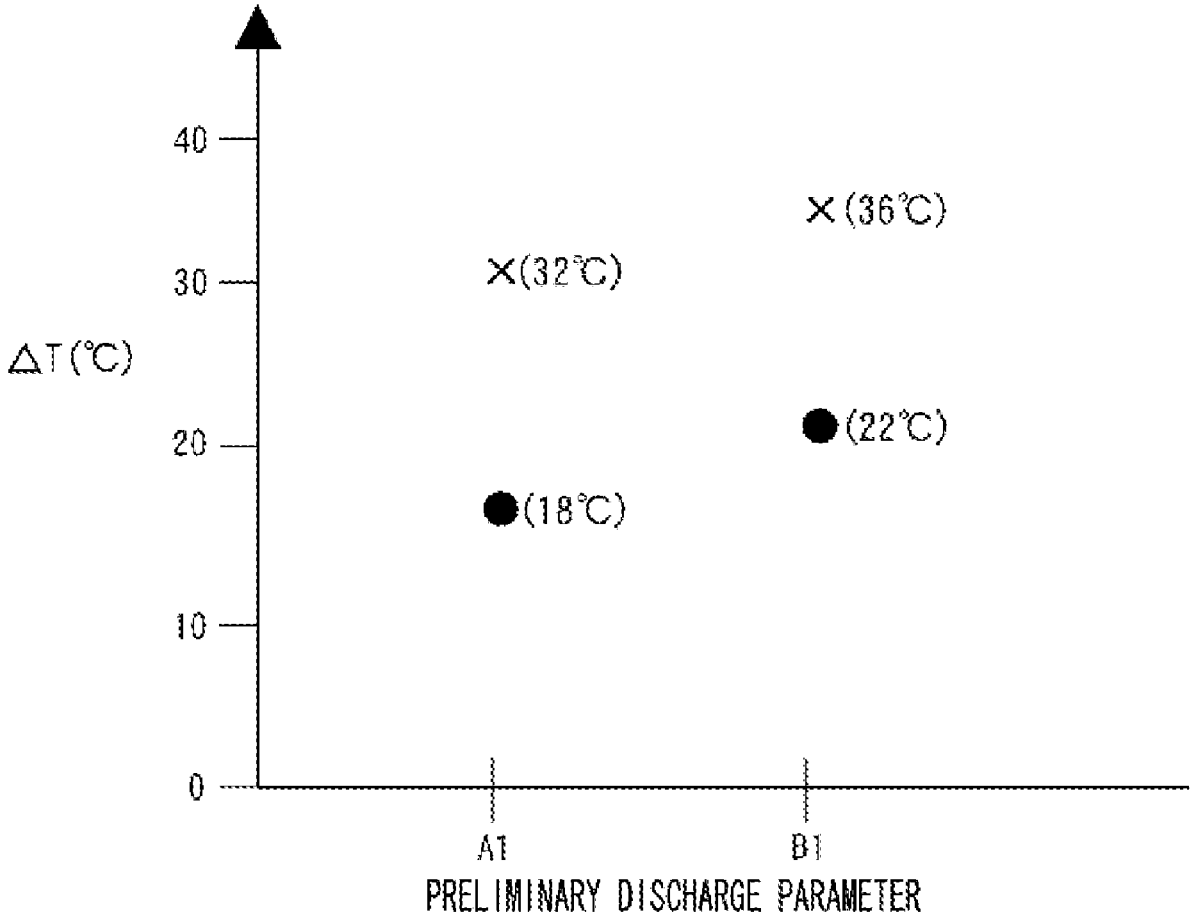
FIG. 5 is a graph illustrating an example of a temperature increase of the recording head when preliminary discharge is carried out using the parameters A1 and B1.

FIG. 5 illustrates an example of a temperature increase of the recording head when preliminary discharge is carried out using the parameters A1 and B1 in a case where ink is present, and ink is not present, respectively. In FIG. 5, a black circle mark (●) indicates a temperature increase when ink is present, while a cross mark (x) indicates a temperature increase when no ink is present.

For example, when preliminary discharge is carried out using the parameter A1 at a temperature 30° C. of the recording head, a temperature increases by 18° C. if ink is present, and thus a temperature of the recording head is 30° C.+18° C.=48° C. On the other hand, since a temperature increases by 32° C. if no ink is present, a temperature of the recording head is 30° C.+32° C.=62° C.

When preliminary discharge is carried out using the parameter B1 at a recording head temperature of 30° C., a temperature increases by 22° C. if ink is present, and thus a temperature of the recording head is 30° C.+22° C.=52° C. On the other hand, since a temperature increases by 36° C. if no ink is present, a temperature of the recording head is 30° C.+36° C.=66° C.

When the temperature of the recording head reaches 60° C. or more, to protect the recording head, the situation is treated as an abnormal temperature increase and an error. Thus, when preliminary discharge is carried out using the parameters A1 and B1 when no ink is present, the process is in a state of an abnormal temperature increase and error.

Thus, according to the first exemplary embodiment, based on the remaining amount of ink in the ink tank detected by the detection unit 318, parameters used for preliminary discharge are controlled.

FIG. 6 illustrates examples of parameters A2 and B2 for preliminary discharge when the remaining amount of ink is small according to the first exemplary embodiment. When the remaining amount of ink is small, the remaining amount of ink is determined to be small by the detection unit 318. In this case, 5% of an ink tank capacity is used as a threshold value to determine that the remaining amount of ink is "SMALL".

According to the first exemplary embodiment, as to the parameters A2 and B2, as compared with the parameters A1 and B1 illustrated in FIG. 4, a driving frequency is set low to reduce discharge energy per unit time. More specifically, a driving frequency of the parameter A2 is 7.5 kHz which is ½ of the driving frequency 15 kHz of the parameter A1. Time spent for preliminary discharge using the parameter A2 is (4000)/(7.5 kHz)×4 colors=about 2.1 seconds. A driving frequency of the parameter B2 is 5 kHz which is ⅓ of the driving frequency 15 kHz of the parameter B1. Time spent for preliminary discharge using the parameter B2 is (8000)/(5 kHz)×4 colors=about 6.4 seconds. In other words, when the parameters A2 and B2 are set, energy applied per unit time is smaller as compared with the parameters A1 and B1.

Figure 7:
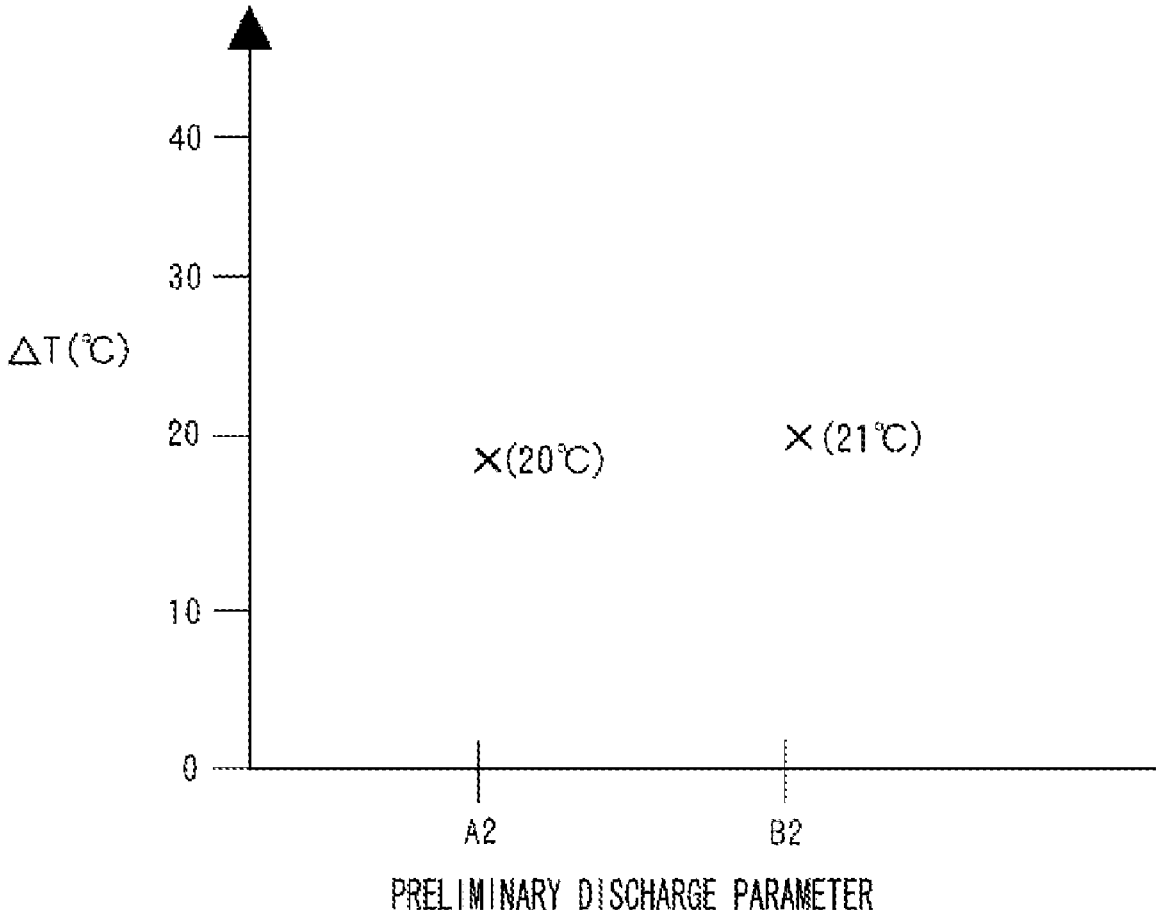
FIG. 7 is a graph illustrating an example of a temperature increase of the recording head when preliminary discharge is carried out using the parameters A2 and B2.

FIG. 7 illustrates an example of a temperature increase of the recording head when preliminary discharge is carried out using the parameters A2 and B2 in a case where the remaining amount of ink is small. In FIG. 7, a cross (x) mark indicates a temperature increase when no ink is present.

When preliminary discharge is carried out using the parameter A2 at a recording head temperature of 30° C., a temperature increases by 20° C., and thus a temperature of the recording head is 30° C.+20° C.=50° C. When preliminary discharge is carried out using the parameter B2 at a recording head temperature of 30° C., a temperature increases by 21° C., and thus a temperature of the recording head is 30° C.+21° C.=51° C.

Thus, it can be recognized that even when no ink is present, by carrying out the preliminary discharge using the parameters A2 and B2, the recording head protection function described above does not operate.

Figure 8:
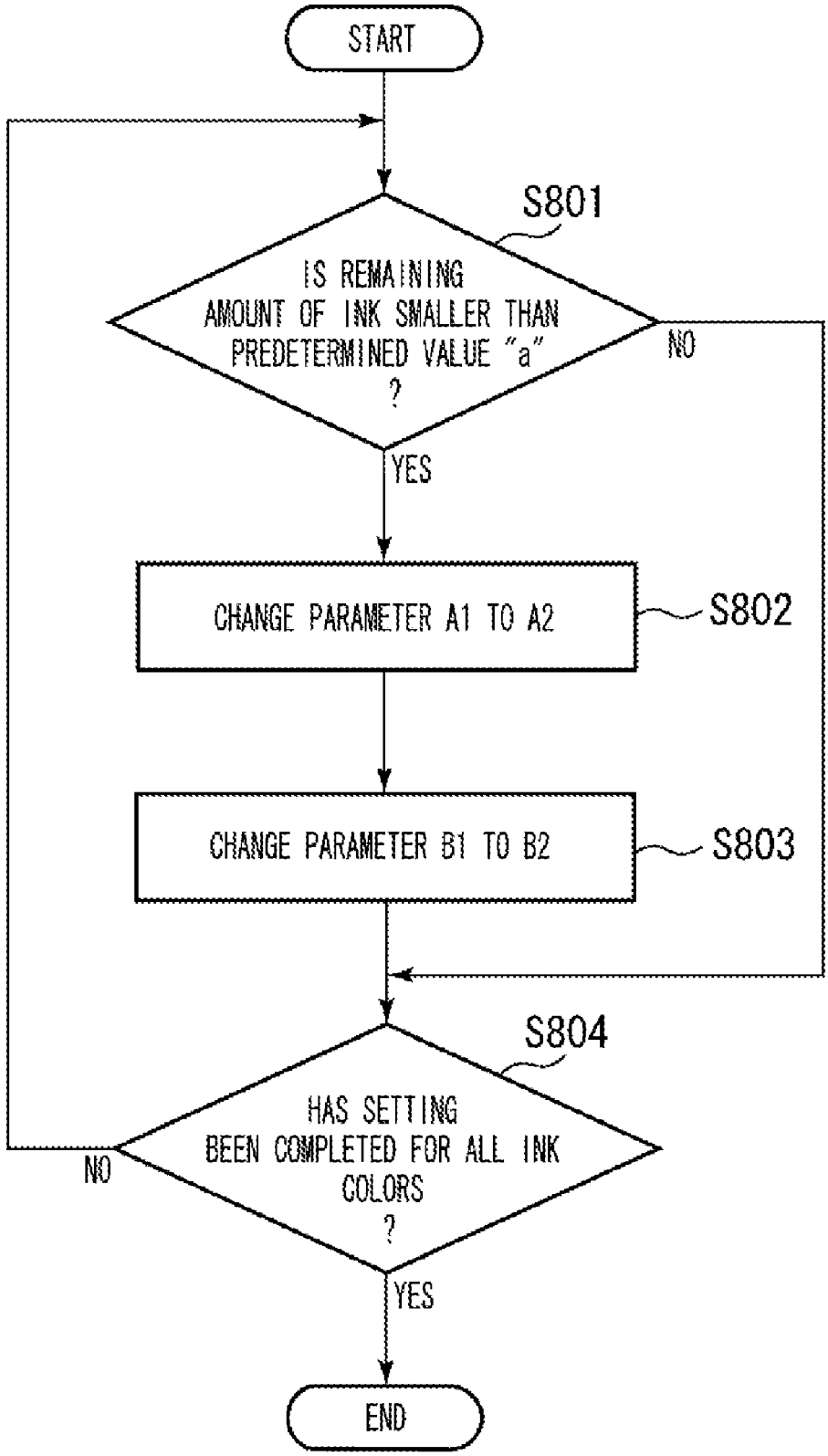
FIG. 8 is a flowchart illustrating a process of setting preliminary discharge parameters in the ink jet recording apparatus according to the first exemplary embodiment.

FIG. 8 is a flowchart illustrating a process of setting preliminary discharge parameters in the ink jet recording apparatus according to the first exemplary embodiment. The operation described below is realized by, for example, executing the program stored in the ROM 301 via the CPU 300. It is presumed that the parameters A1 and B1 have been set in an initial state.

In step S801, the CPU 300 determines whether the remaining amount of ink in each of the four-color ink tanks is smaller than a predetermined value "a". For example, in an embodiment, the predetermined value "a" is 5% of an ink tank capacity. If it is determined that the remaining amount of ink detected by the detection unit 318 is more than or equal to 5% (NO in step S801), the process proceeds to step S804. On the other hand, if it is determined that the remaining amount of ink is less than 5% (YES in step S801), in other words, if the remaining amount of ink is determined to be small, the process proceeds to step S802.

In the step S802, the CPU 300 changes the currently set parameter A1 to a parameter A2. In other words, the CPU 300 changes a parameter of preliminary discharge to remove thickened ink when the carriage stands by for a long time while the discharge ports of the recording head are covered with caps. The CPU 300 also changes a parameter of preliminary discharge to remove ink stuck on the port face due to spattering of the ink from the recording medium during recording, after completing a wiping operation. The stuck ink is disposed on the port face where the discharge ports of the recording head are arranged side by side.

In step S803, the CPU 300 changes the currently set parameter B1 to a parameter B2. In other words, the CPU 300 changes a parameter of preliminary discharge to remove mixed color inks generated in the cap when the four-color inks of black, cyan, magenta, and yellow are sucked by the same cap.

In step S804, the CPU 300 determines whether the step S801 has been executed for all the recording heads of four colors. If there is a recording head of a color that is yet to be subjected to step S801 (NO in step S804), the process returns to the step S801. If step S801 has been executed for all the colors (YES in step S804), the CPU 300 finishes the flow to carry out preliminary discharge by using the set parameters.

In the flowchart illustrated in FIG. 8, the CPU 300 is configured to execute both of steps S802 and S803 if it is determined that the remaining amount of ink is less than a predetermined value "a". However, the CPU 300 may selectively execute steps S802 and S803 if a type of preliminary discharge is known beforehand.

In the first exemplary embodiment, the driving frequencies (i.e., parameters used for the preliminary discharge) are ½ and ⅓. However, the exemplary embodiment is not limited to those frequencies. Any driving frequency can be used as long as they are low (i.e., cycles are long).

As described above, in the preliminary discharge in the ink jet recording apparatus of the first exemplary embodiment, the driving frequencies are set low according to the remaining amount of ink. With this configuration, during preliminary discharge when a remaining amount of ink is small or no ink is present, energy applied to the recording head per unit time is reduced. As a result, a level of a temperature increase of the recording head can be reduced, and a frequency of the recording head protection function execution can be reduced.

Even in the case where the parameters A2 and B2 are used without detecting the remaining amount of ink, operation of the recording head protection function can be reduced. However, if the two types of parameters are selectively used as described above, the preliminary discharge at a normal time can be executed within a shorter time. For example, the periods of time necessary for the preliminary discharge using the parameters A1 and B1 are respectively about 1.0 second and about 2.1 seconds. On the other hands, the periods of time necessary for performing the preliminary discharge using the parameters A2 and B2 are respectively about 2.1 seconds and about 6.4 seconds. Accordingly, when the remaining amount of ink is large, by using the parameters A1 and B1, time necessary for performing preliminary discharge can be shortened.

Second Exemplary Embodiment

A second exemplary embodiment of the present invention is directed to a method for dividing a plurality of discharge ports arranged on a recording head into a plurality of blocks (N blocks), and carrying out preliminary discharge N times by shifting timing of driving each block. An apparatus configuration is similar to that of the first exemplary embodiment (FIGS. 1 to 3), and thus description thereof will be omitted.

FIG. 9 illustrates examples of parameters A3 and B3 of preliminary discharge when the remaining amount of ink is small according to the second exemplary embodiment. When the remaining amount of ink is small, the remaining amount of ink is determined to be small by a detection unit 318. In this case, 5% of an ink tank capacity is used as a threshold value to determine that the remaining amount of ink is "SMALL".

Figure 10:
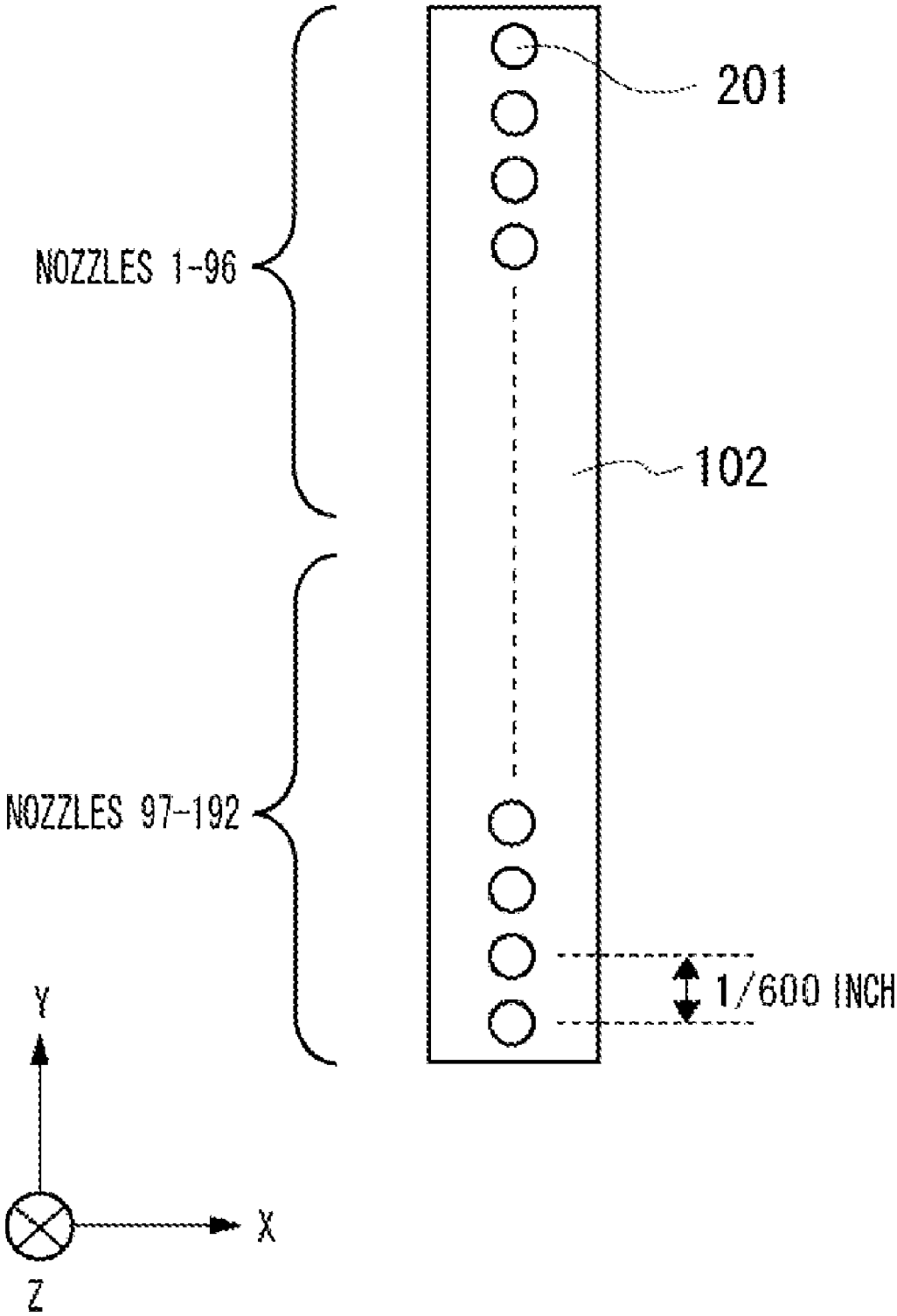
FIG. 10 is a diagram illustrating an example where discharge ports of a recording head are divided into two blocks.

In the parameters A3 and B3, as compared with the parameters A1 and B1 illustrated in FIG. 4, discharge energy per unit time is reduced by dividing the plurality of discharge ports into a plurality of blocks and shifting timing of ink discharge. FIG. 10 illustrates an example where discharge ports of a recording head 102 are divided into two blocks. More specifically, in the case of the parameter A3, the discharge ports are divided into two blocks of (1) discharge port positions 1 to 96, and (2) discharge port positions 97 to 192. When the preliminary discharge is instructed, in order to carry out preliminary discharge of (1) the discharge port positions 1 to 96, energy is applied to corresponding heating elements. After a predetermined time interval passes, energy is applied to heating elements corresponding to the (2) discharge port positions 97 to 192 to execute preliminary discharge. Time necessary for carrying out the preliminary discharge using the parameter A3 is (4000)/(15 kHz)×4 colors×2 blocks=about 2.1 seconds. In the case of the parameter B3, discharge ports are divided into three blocks of (1) discharge port positions 1 to 64, (2) discharge port positions 65 to 128, and (3) discharge port positions 129 to 192. Time necessary for carrying out preliminary discharge using the parameter B3 is (8000)/(15 kHz)×4 colors×3 blocks=about 6.4 seconds. In other words, when the parameters A3 and B3 are set, energy applied per unit time is smaller as compared with the parameters A1 and B1.

Figure 11:
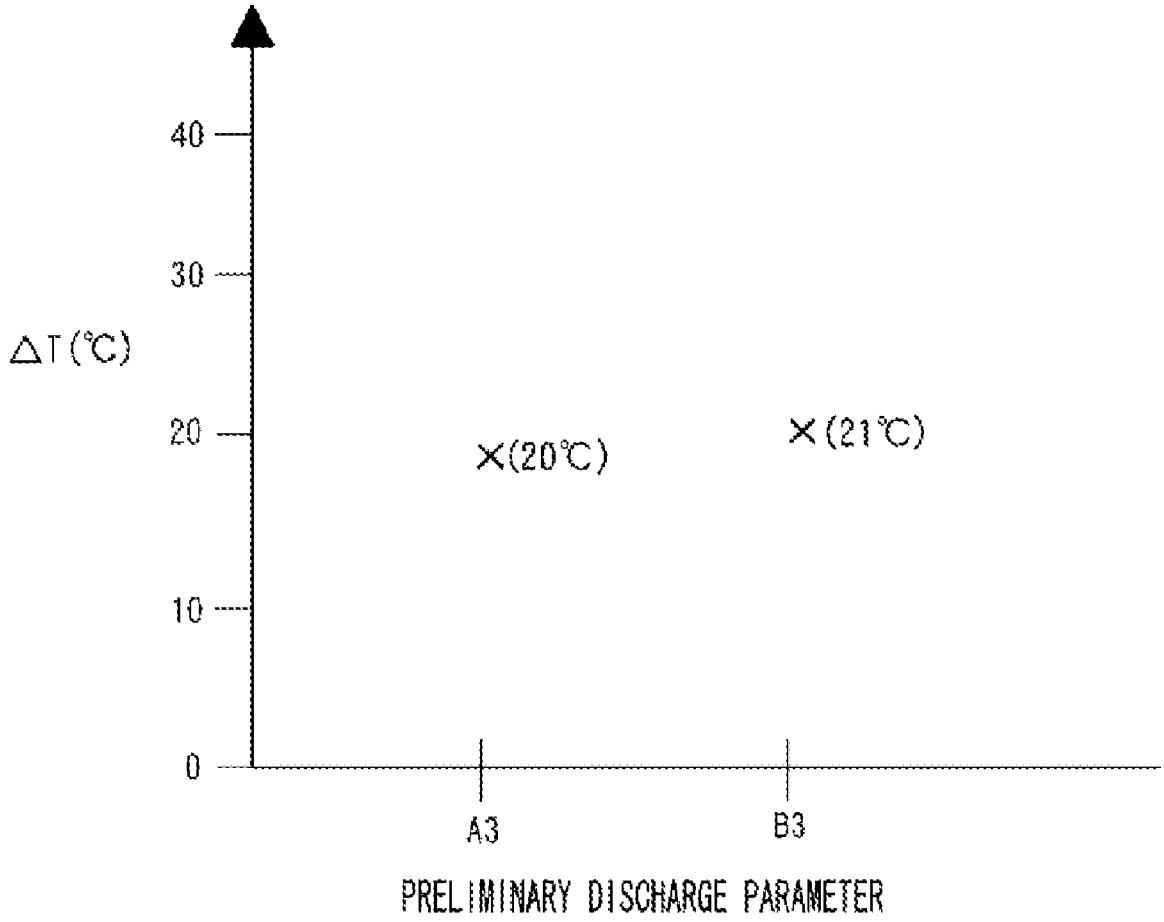
FIG. 11 is a graph illustrating an example of a temperature increase of the recording head when preliminary discharge is carried out using the parameters A3 and B3.

FIG. 11 illustrates an example of a temperature increase of the recording head when preliminary discharge is carried out using the parameters A3 and B3 while the remaining amount of ink is small. In FIG. 11, a cross (x) mark indicates a temperature increase when there is no ink.

When the preliminary discharge is carried out using the parameter A3 at a recording head temperature of 30° C., a temperature increases by 20° C., and thus a temperature of the recording head is 30° C.+20° C.=50° C. When the preliminary discharge is carried out using the parameter B3 at a recording head temperature of 30° C., a temperature increases by 21° C., and thus a temperature of the recording head is 30° C.+21° C.=51° C.

Accordingly, it can be recognized that even when there is no ink, by executing the preliminary discharge using the parameters A3 and B3, a recording head protection function is prevented from operating.

Figure 12:
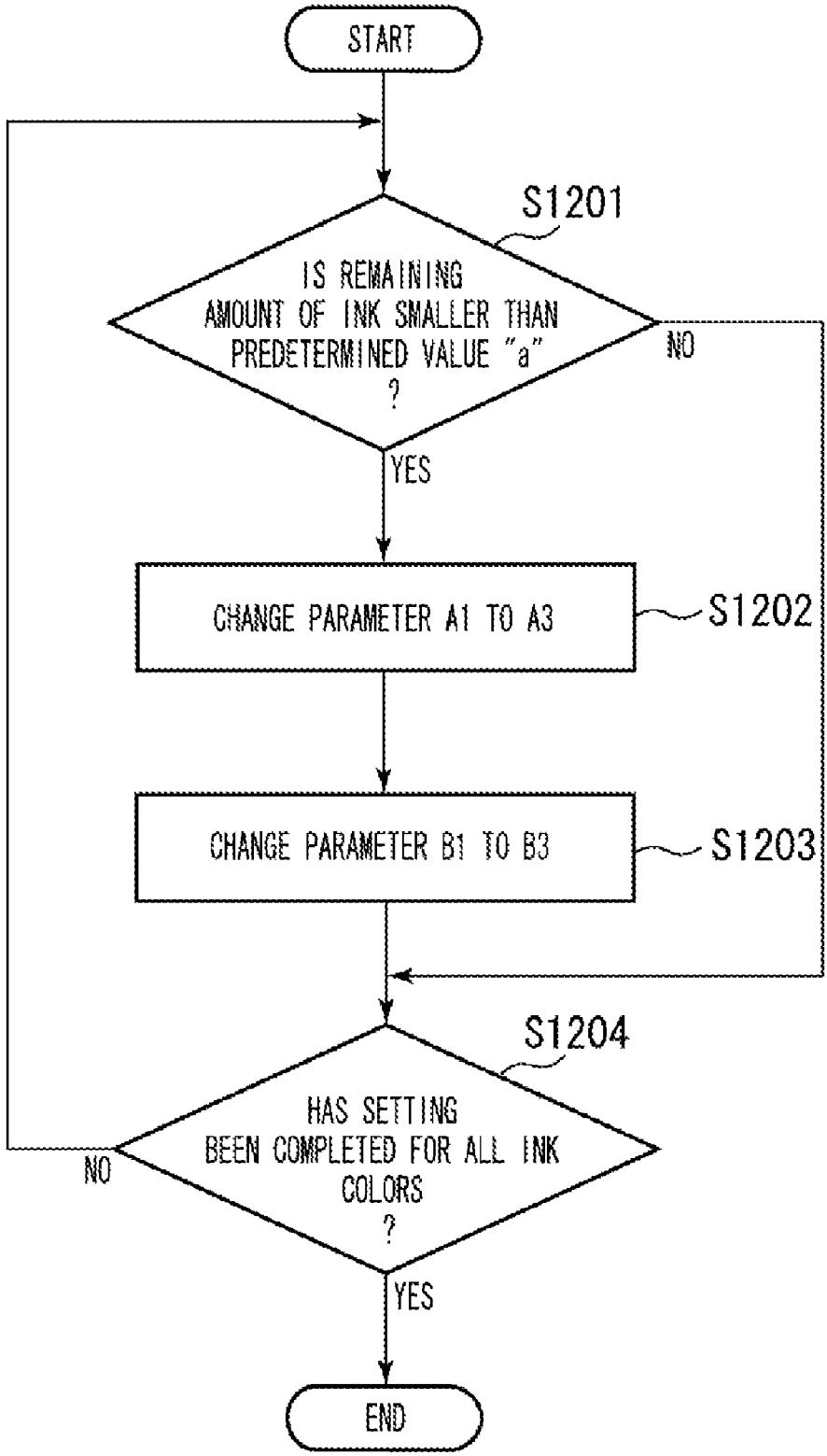
FIG. 12 is a flowchart illustrating a process of setting preliminary discharge parameters in an ink jet recording apparatus according to the second exemplary embodiment.

FIG. 12 is a flowchart illustrating a process of setting preliminary discharge parameters in the ink jet recording apparatus of the second exemplary embodiment. An operation described below is realized by executing a program stored in a ROM 301 via a CPU 300. Parameters A1 and B1 are set in an initial state.

In step S1201, the CPU 300 determines whether the remaining amount of ink in each of the four-color ink tanks is smaller than a predetermined value "a". For example, the predetermined value "a" is 5% of an ink tank capacity. If it is determined that the remaining amount of ink detected by the detection unit 318 is more than or equal to 5% (NO in step S1201), the process proceeds to step S1204. On the other hand, if it is determined that the remaining amount of ink is less than 5% (YES in step S1201), in other words, if the remaining amount of ink is determined to be small, the process proceeds to step S1202.

In step S1202, the CPU 300 changes the currently set parameter A1 to a parameter A3. In other words, the CPU 300 changes a parameter of preliminary discharge to remove thickened ink when the carriage stands by for a long time when the discharge ports of the recording head are covered with caps. The CPU 300 also changes a parameter for preliminary discharge to remove ink stuck on the port face caused by spattering of the ink from the recording medium during recording, after completing a wiping operation. On the port face, the discharge ports of the recording head are arranged side by side.

In step S1203, the CPU 300 changes the currently set parameter B1 to a parameter B3. In other words, the CPU 300 changes a parameter of the preliminary discharge to remove mixed color ink generated in the cap when the four-color inks of black, cyan, magenta, and yellow are sucked by the same cap.

In step S1204, the CPU 300 determines whether step S1201 has been executed for all the recording heads of four colors. If there is a recording head of a color that is yet to be subjected to step S1201 (NO in step S1204), the process returns to step S1201. If step S1201 has been executed for all the colors (YES in step S1204), the CPU 300 finishes the flow.

According to the flowchart, the CPU 300 always executes both of steps S1202 and S1203. However, the CPU 300 may selectively execute steps S1202 and S1203 if a type of preliminary discharge is known beforehand.

According to the second exemplary embodiment, the plurality of discharge ports on the recording heads are equally divided into two or three. However, a dividing method is not limited to this method. Furthermore, a combined use of discharges from all the discharge port positions is also feasible.

As described above, in the preliminary discharge in the ink jet recording apparatus of the second exemplary embodiment, when the remaining amount of ink is less than the predesignated remaining amount of ink, the discharge ports are divided into N blocks. The preliminary discharge is carried out for each block and the discharge ports are driven N times. With this configuration, during the preliminary discharge when the remaining amount of ink is small or no ink is present, the total number of times of driving the discharge ports per unit time in the recording head is reduced. Thus, energy applied to the recording heads can be reduced. As a result, a level of a temperature increase of the recording head can be reduced, and also operation of the recording head protection function can be reduced.

Third Exemplary Embodiment

According to a third exemplary embodiment of the present invention, energy applied per unit time to a recording head is reduced by controlling of a discharge pulse width as described below.

According to the first and second exemplary embodiments, the CPU 300 applies rectangular pulses to the heating elements of the discharge ports. A voltage of the discharge pulse is 24 V, and a discharge pulse width is fixed at 1μ second irrespective of the remaining amount of ink. According to the third exemplary embodiment, a pulse width of preliminary discharge is similarly set to 1μ second when the remaining amount of ink is large. However, when the remaining amount of ink is small, a discharge pulse width of preliminary discharge is set to 0.7μ second. A voltage is not changed. Energy applied per unit time to the recording head is proportional to a discharge pulse width when driving frequencies/the numbers of applying times are equal. With this configuration, energy applied per unit time can be reduced.

However, it is known that when a discharge pulse width is reduced, the amount of discharged ink droplets is also reduced. Accordingly, if only the discharge pulse width is reduced, the total discharge amount of ink accompanying the preliminary discharge is reduced, which results in a limited recovery effect of the preliminary discharge. Thus, according to the third exemplary embodiment, not only the discharge pulse width is reduced but also the number of times of discharging inks, i.e., the number of applied pulses, is increased more than the normal case.

FIG. 13 illustrates examples of parameters A4 and B4 according to the third exemplary embodiment. As to both of the parameters A4 and B4, discharge pulse widths are set to 0.7μ second, which is shorter than 1μ second of the normal case. However, as described above, if only the discharge pulse width is reduced, an effect of preliminary discharge is limited. Accordingly, 8000 and 16000 discharge ports are respectively set as the numbers of applied pulses for the parameters A4 and B4 to maintain effects of preliminary discharge.

Figure 14:
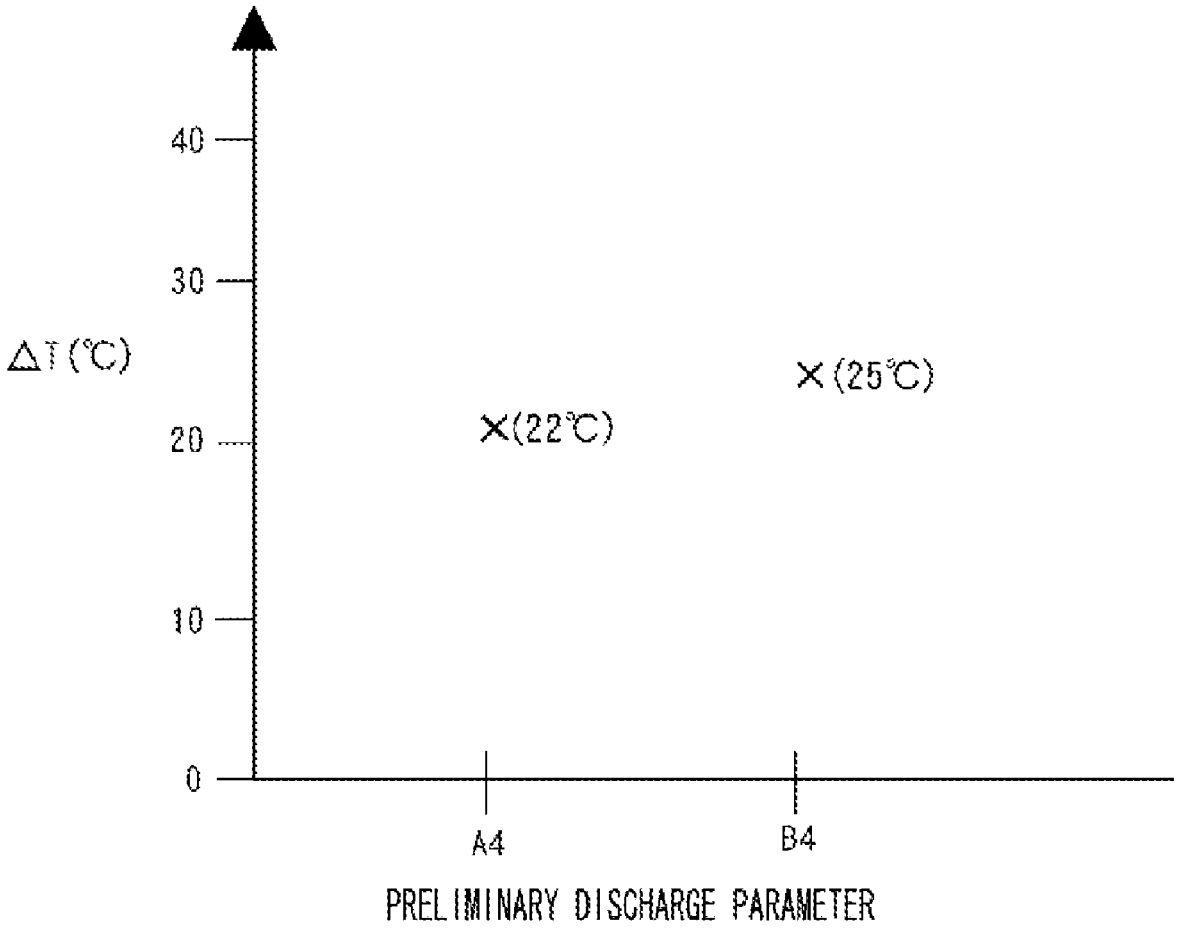
FIG. 14 is a graph illustrating an example of a temperature increase of a recording head when preliminary discharge is carried out using the parameters A4 and B4.

FIG. 14 illustrates an example of a temperature increase of the recording head when preliminary discharge is carried out using the parameters A4 and B4 while the remaining amount of ink is small. In FIG. 14, a cross (x) mark indicates a temperature increase when there is no ink.

When preliminary discharge is carried out using the parameter A4 at a recording head temperature of 30° C., a temperature increases by 22° C., and thus a temperature of the recording head is 30° C.+22° C.=52° C. When the preliminary discharge is carried out using the parameter B4 at a recording head temperature of 30° C., a temperature increases by 25° C., and thus a temperature of the recording head is 30° C.+25° C.=55° C.

Thus, even if there is no ink, by carrying out the preliminary discharge using the parameters A4 and B4, operation of the recording head protection function can be reduced.

Fourth Exemplary Embodiment

According to a fourth exemplary embodiment of the present invention, energy applied per unit time to a recording head is reduced by controlling a voltage of an applied pulse as described below. According to the third embodiment, a driving voltage of the recording head used for recording is fixed at 24 (V) irrespective of the remaining amount of ink. According to the fourth exemplary embodiment, a driving voltage is set to 24 (V) when the remaining amount of ink is large. However, when the remaining amount of ink is small, a driving voltage is set to 20 (V). Energy applied per unit time to the recording head is proportional to a discharge pulse width when driving frequencies/the numbers of applying times are equal. With this configuration, energy applied per unit time can be reduced.

However, it is known that when a driving voltage is set low, the amount of discharged ink droplets is reduced. Accordingly, if only the driving voltage is set low, the total discharge amount of ink accompanying preliminary discharge is reduced which results in a limited recovery effect of the preliminary discharge. Thus, according to the fourth exemplary embodiment, not only the driving voltage is set low but also the number of times of discharging inks, i.e., the number of times of applying energy, is increased more than the normal case.

FIG. 15 illustrates examples of parameters A5 and B5 according to the fourth exemplary embodiment. As to both of the parameters A5 and B5, a voltage of discharge pulses is set to 20 (V), which is lower than 24 (V) of the normal case. However, if only the voltage is set low, an effect of preliminary discharge is limited. Accordingly, 8000 and 16000 discharge ports are respectively set as the numbers of applied pulses for the parameters A5 and B5 of the discharge ports to maintain effects of preliminary discharge.

Figure 16:
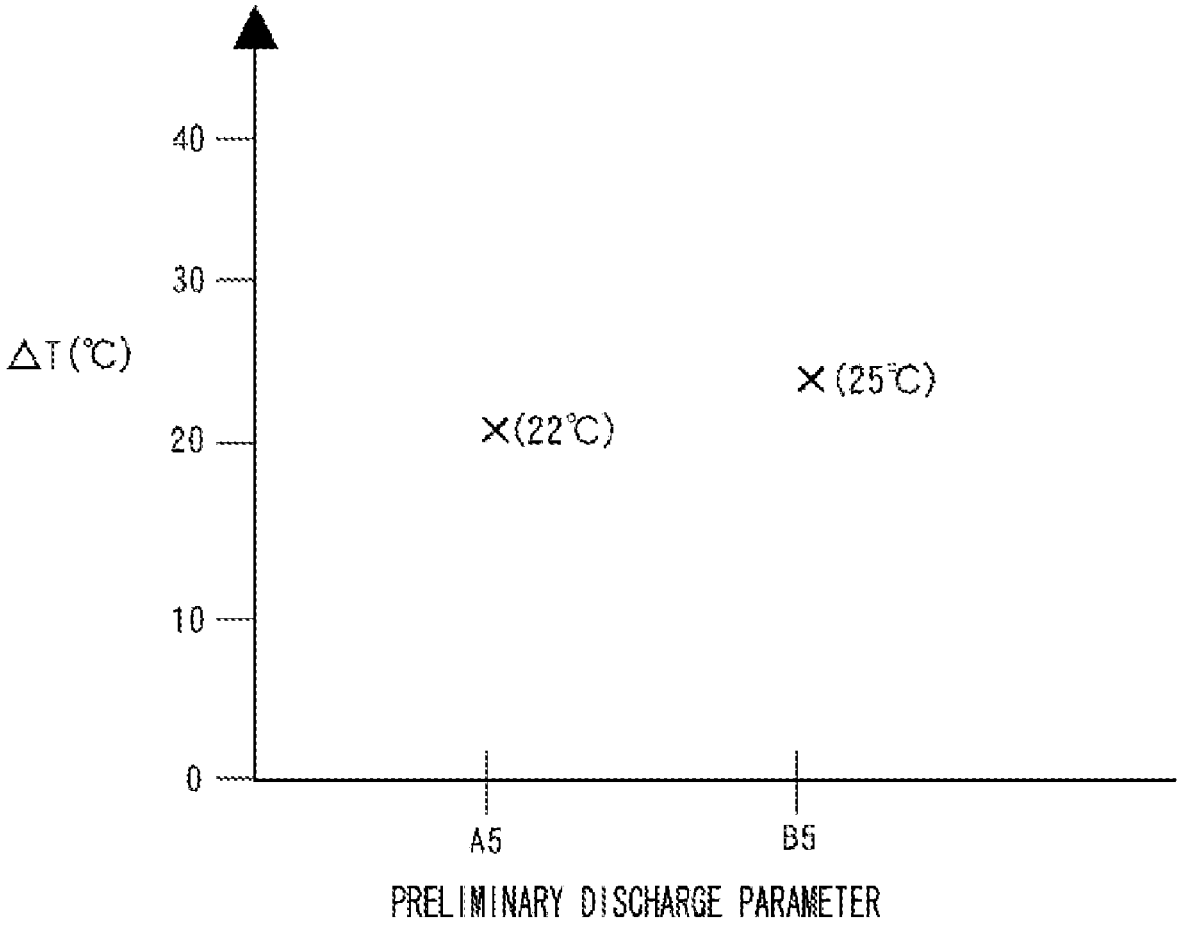
FIG. 16 is a graph illustrating an example of a temperature increase of a recording head when preliminary discharge is carried out using the parameters A5 and B5.

FIG. 16 illustrates an example of a temperature increase of the recording head when preliminary discharge is carried out using the parameters A5 and B5 while the remaining amount of ink is small. In FIG. 16, a cross (x) mark indicates a temperature increase when there is no ink.

When the preliminary discharge is carried out using the parameter A5 at a recording head temperature of 30° C., a temperature increases by 22° C., and thus a temperature of the recording head is 30° C.+22° C.=52° C. When preliminary discharge is carried out using the parameter B5 at a recording head temperature of 30° C., a temperature increases by 25° C., and thus a temperature of the recording head is 30° C.+25° C.=55° C.

Thus, even if there is no ink, by carrying out preliminary discharge using the parameters A5 and B5, operation of the recording head protection function can be reduced.

According to the first to fourth embodiments, by changing only one item of the parameters, discharge energy per unit time is reduced. However, two or more parameters may be combined to change the discharge energy.

Fifth Exemplary Embodiment

A fifth exemplary embodiment of the present invention is directed to an ink jet recording apparatus which includes a plurality of recording modes using different inks. It is presumed that three recording modes of (1) all four colors, (2) only a black color, (3) and three colors of cyan, magenta, and yellow are provided. Other components are similar to those of the first exemplary embodiment (FIGS. 1 to 3), and thus description thereof will be omitted.

Figure 17:
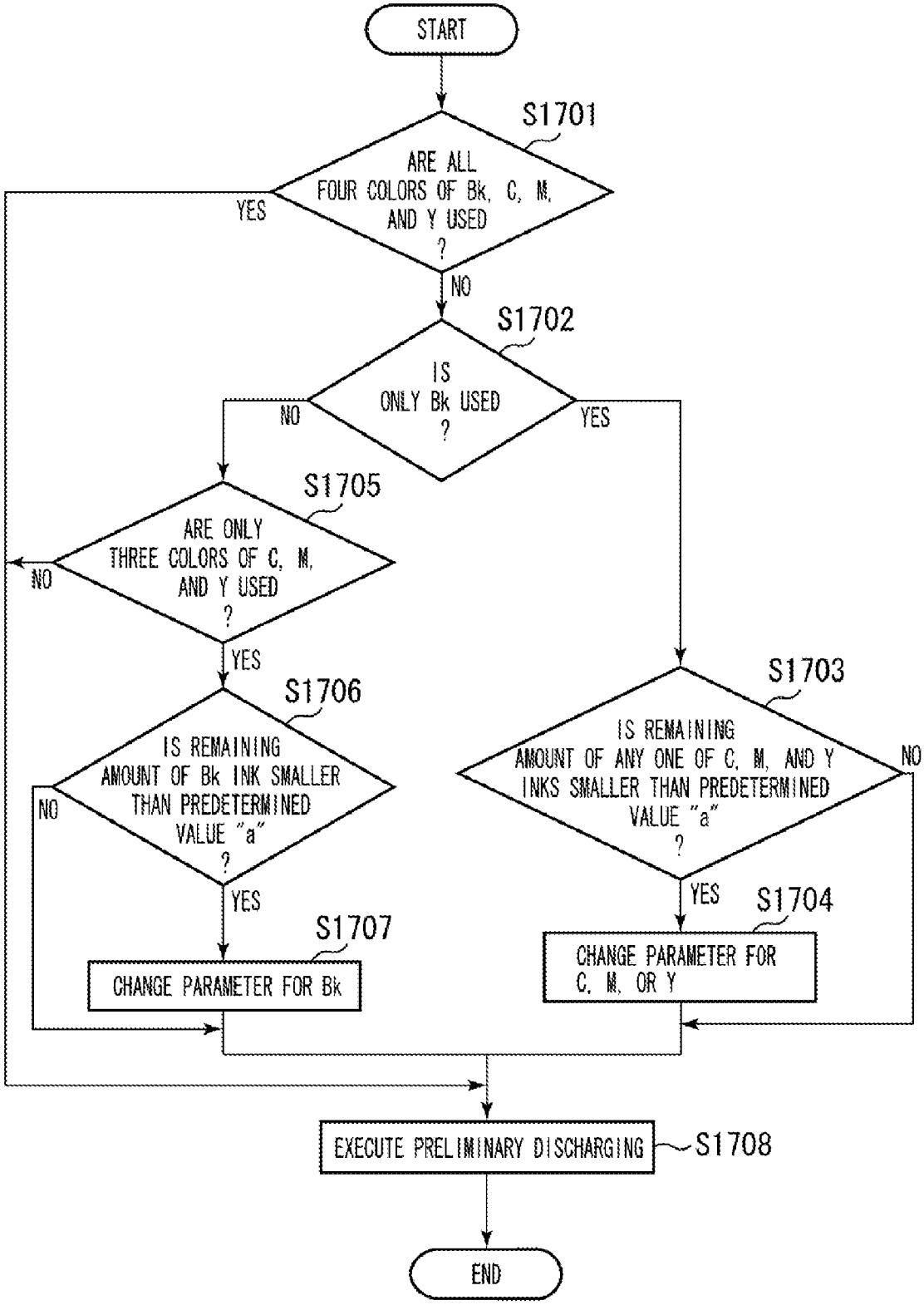
FIG. 17 is a flowchart illustrating a process of setting preliminary discharge parameters in an ink jet recording apparatus according to a fifth exemplary embodiment of the present invention.

FIG. 17 is a flowchart illustrating a process of setting preliminary discharge parameters in the ink jet recording apparatus of the fifth exemplary embodiment. An operation described below is realized, for example, by executing a program stored in a ROM 301 via a CPU 300. In an initial state, parameters A1 and B1 are set to recording heads corresponding to four colors.

In step S1701, the CPU 300 determines whether the ink jet recording apparatus is set to a recording mode using all four colors of black, cyan, magenta, and yellow. If the ink jet recording apparatus is set to the recording mode using all four colors of black, cyan, magenta, and yellow (YES in step S1701), the process proceeds to step S1708. If the ink jet recording apparatus is not set to the recording apparatus using all four colors of black, cyan, magenta, and yellow (NO in step S1701), the process proceeds to step S1702.

In step S1702, the CPU 300 determines whether the ink jet recording apparatus is set to a recording mode using only a black color. If the ink jet recording apparatus is set to the recording mode using only the black color (YES in step S1702), the process proceeds to step S1703. If the ink jet recording apparatus is not set to the recording mode using only the black color (NO in step S1702), the process proceeds to step S1705.

In step S1703, the CPU 300 determines whether the remaining amount of ink for each of three colors of cyan, magenta, and yellow is smaller than a predetermined value "a". The predetermined value "a" is, for example, 5% of an ink tank capacity. If the remaining amount of ink of each color is less than the predetermined value "a" (YES in step S1703), the process proceeds to step S1704. If the remaining amount of ink of each color is more than or equal to the predetermined value "a" (NO in step S1703), the process proceeds to step S1708.

In step S1704, the CPU 300 changes preliminary discharge parameters of the recording heads of three colors of cyan, magenta, and yellow. More specifically, the CPU 300 can use one of the above described parameters A2 to A5 and B2 to B5.

In step S1705, the CPU 300 determines whether the ink jet recording apparatus is set to a recording mode using only three colors of cyan, magenta, and yellow. If the ink jet recording apparatus is set to the recording mode using only three colors of cyan, magenta, and yellow (YES in step S1705), the process proceeds to step S1706. If the ink jet recording apparatus is not set to the recording mode using only three colors of cyan, magenta, and yellow (NO in step S1705), the process proceeds to step S1708.

In step S1706, the CPU 300 determines whether the remaining amount of ink of black is smaller than a predetermined value "a". The predetermined value "a" is, for example, 5% of an ink tank capacity. If the remaining amount of ink of black is less than the predetermined value "a" (YES in step S1706), the process proceeds to step S1707. If the remaining amount of ink of black is more than or equal to the predetermined value "a" (NO in step S1706), the process proceeds to step S1708.

In step S1707, the CPU 300 changes preliminary discharge parameters of the recording head of black. More specifically, the CPU 300 can use one of the above described parameters A2 to A5 and B2 to B5.

In step S1708, the CPU 300 executes preliminary discharge according to set parameters.

Such control enables reduction of abnormal temperature increase (i.e., errors) generated in the recording head of ink which is not used in a current recording mode. In other words, deterrence of a recording operation caused by an error can be restrained that is conventionally generated as to an ink color which is not originally used.

Recording heads for discharging inks of black, cyan, magenta, and yellow may be arranged in the same cartridge, or a recording head section may include two types of cartridges. In both cases, the above described operation flowchart can be carried out.

Figure 18A:
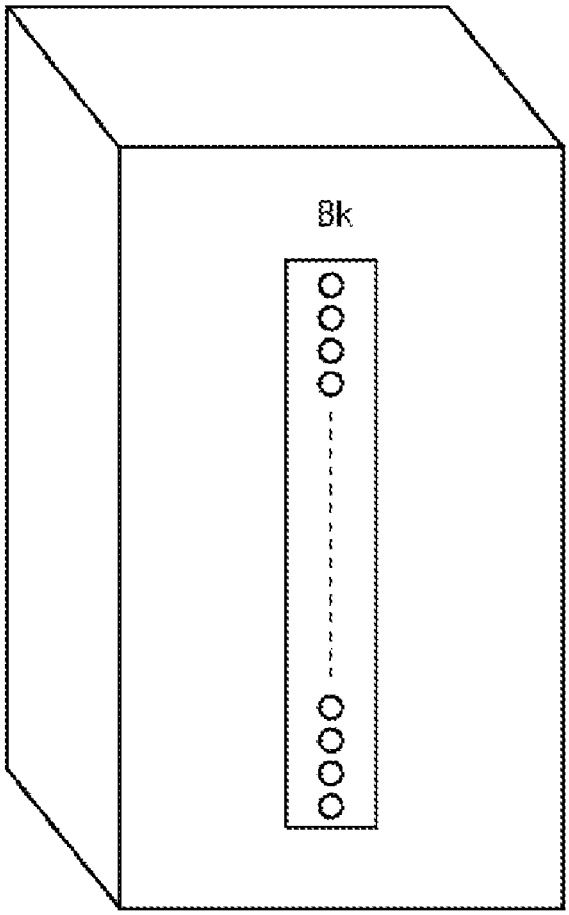
FIG. 18 is a diagram illustrating an example of a recording head which includes two cartridges.
Figure 18B:
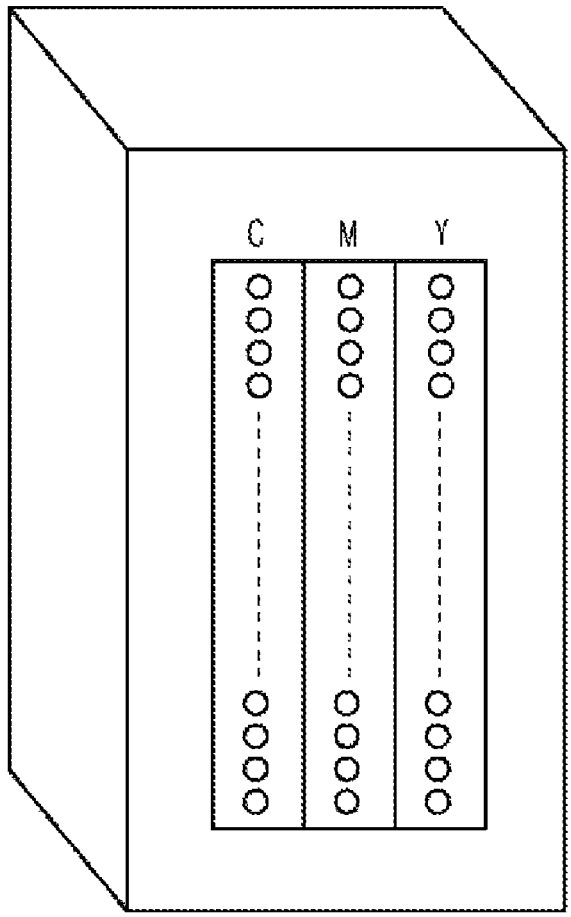

FIG. 18 illustrates an example in which a recording head section includes two cartridges, i.e., a cartridge only for black, and a cartridge for three colors of cyan, magenta, and yellow. These cartridges may be removable. Recording may be also carried out using only attached cartridges. Even when all the cartridges are attached, a cartridge used for recording may be designated according to a recording mode by an instruction of a user.

The exemplary embodiments and the modified example have been described using four-color inks of black, cyan, magenta, and yellow. However, the present invention is not limited to the ink jet recording apparatus of four-color inks. For example, light cyan which is a low-concentrated cyan color, and light magenta which is a low-concentrated magenta color may be added to the four colors of black, cyan, magenta, and yellow so that six colors are used. Needless to say, the invention is not limited to six colors. Even with the smaller or larger number of colors, similar effects can be obtained. Even in the case of the same ink color, parameters changed depending on types of dye and pigment inks may be used.

Other Exemplary Embodiments

The present invention may be applied to a system which includes a plurality of devices, or an apparatus which includes one device.

The present invention is achieved by supplying a program for realizing the functions of the exemplary embodiments directly to the system or the apparatus from a remote place, and reading and executing supplied program codes via the system or the apparatus. Thus, the program codes installed in a computer to realize the functional process of the invention are within the invention.

In this case, as long as program functions are provided, any forms of programs such as an object code, a program executed by an interpreter, or script data supplied to an OS can be employed.

As a recording medium for supplying programs, for example, a Floppy® disk, a hard disk, an optical disk (CD or DVD), a magneto-optical disk, a nonvolatile memory card, or a ROM can be used.

The above described functions of the exemplary embodiments are realized by executing the program read via the computer. Additionally, based on an instruction of the program, the OS operating in the computer executes some or all parts of a real process and, through this process, the above described functions of the exemplary embodiments can be realized.

The program read from the recording medium is written in a memory installed in a function extension board inserted into the computer or a function extension unit connected to the computer. Then, based on the instruction of the program, a CPU installed in the function extension board or the function extension unit executes some or all parts of a real process and, through this process, the above described functions of the exemplary embodiments can be realized.

According to the exemplary embodiments of the present invention, a technology of reducing an abnormal temperature increase in the recording head caused by preliminary discharge can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-009583 filed Jan. 18, 2007, which is hereby incorporated by reference herein in its entirety.

What is claimed is:

1. An ink jet recording apparatus for discharging ink from a recording head to a recording medium to execute recording, comprising:

the recording head including a plurality of discharge ports for discharging ink supplied from an ink tank, and a plurality of heating elements, each heating element provided for each of the discharge ports;

a detection unit configured to detect a remaining amount of ink in the ink tank;

a preliminary discharge unit configured to discharge ink from the discharge ports, unrelated to recording, by applying energy to the heating elements to recover the recording head; and a control unit configured to perform control so that when the remaining amount of ink detected by the detection unit is less than a predesignated remaining amount of ink, energy applied to the heating elements per unit time by the preliminary discharge unit is smaller as compared with energy applied to the heating elements per unit time when the remaining amount of ink is more than or equal to the predesignated remaining amount of ink.

2. The ink jet recording apparatus according to claim 1, wherein the control unit is configured to perform control so that when the remaining amount of ink detected by the detection unit is less than the predesignated remaining amount of ink, a driving frequency of the preliminary discharge unit is smaller as compared with a driving frequency when the remaining amount of ink is more than or equal to the predesignated remaining amount of ink.

3. The ink jet recording apparatus according to claim 1, wherein the control unit is configured to control the preliminary discharge unit so that when the remaining amount of ink detected by the detection unit is less than the predesignated remaining amount of ink, the plurality of discharge ports which are subjected to preliminary discharge is divided into N blocks, and inks are discharged to the blocks N times.

4. The ink jet recording apparatus according to claim 1, wherein the control unit is configured to perform control so that when the remaining amount of ink detected by the detection unit is less than the predesignated remaining amount of ink, a discharge pulse width applied by the preliminary discharge unit is shorter as compared with a discharge pulse width when the remaining amount of ink is more than or equal to the predesignated remaining amount of ink, and the number of applied pulses is lager than the number of applied pulses when the remaining amount of ink is more than or equal to the predesignated remaining amount of ink, to carry out the preliminary discharge.

5. The ink jet recording apparatus according to claim 1, wherein the control unit is configured to perform control so that when the remaining amount of ink detected by the detection unit is less than the predesignated remaining amount of ink, a voltage of a discharge pulse applied by the preliminary discharge unit is lower as compared with a driving voltage when the remaining amount of ink is more than or equal to the predesignated remaining amount of ink, and the number of applied pulses is larger than the number of applied pulses when the remaining amount of ink is more than or equal to the predesignated remaining amount of ink, to carry out preliminary discharge.

6. An ink jet recording apparatus for discharging inks from a plurality of recording heads to a recording medium to execute recording, comprising:

the plurality of recording heads, each recording head including a plurality of discharge ports for discharging ink supplied from an ink tank, and a plurality of heating elements, each heating element provided for each of the discharge ports;

a detection unit configured to detect a remaining amount of ink in each of the ink tanks corresponding to the plurality of recording heads;

a preliminary discharge unit configured to discharge ink from the discharge ports of the plurality of recording heads, unrelated to recording, by applying energy to the heating elements of the plurality of recording heads to recover the plurality of recording heads;

a determination unit configured to determine a recording head which is not used for recording, among the plurality of recording heads; and a control unit configured to perform control so that at least when the remaining amount of ink detected by detection unit corresponding to the recording head determined not to be used for the recording by the determination unit is less than a predesignated remaining amount of ink, energy applied per unit time by the preliminary discharge unit to the recording head is smaller as compared with energy applied per unit time when the remaining amount of ink is more than or equal to the predesignated remaining amount of ink.

7. A method for controlling an ink jet recording apparatus which includes a recording head having a plurality of discharge ports for discharging ink supplied from an ink tank, and a plurality of heating elements, each heating element provided for each of the discharge ports, the ink jet recording apparatus operable to discharge ink from the recording head to a recording medium to execute recording, the method comprising:

detecting a remaining amount of ink in the ink tank;

executing preliminary discharge to discharge ink from the discharge ports, unrelated to recording, by applying energy to the heating elements to recover the recording head; and performing control so that when the detected remaining amount of ink is less than a predesignated remaining amount of ink, energy applied to the heating elements per unit time during execution of the preliminary discharge is smaller as compared with energy applied to the heating elements per unit time when the remaining amount of ink is more than or equal to the predesignated remaining amount of ink.

8. A method for controlling an ink jet recording apparatus which includes a plurality of recording heads, each recording head having a plurality of discharge ports for discharging inks supplied from an ink tank, and a plurality of heating elements, each heating element provided for each of the discharge ports, the ink jet recording apparatus operable to discharge ink from the plurality of recording heads to a recording medium to execute recording, the method comprising:

detecting a remaining amount of ink in each of the ink tanks corresponding to the plurality of recording heads;

executing preliminary discharge to discharge ink from the discharge ports of the plurality of recording heads, unrelated to recording, by applying energy to the heating elements of the plurality of recording heads to recover the plurality of recording heads;

determining a recording head which is not used for recording, among the plurality of recording heads; and performing control so that at least when the detected remaining amount of ink corresponding to the recording head determined not to be used for recording is less than a predesignated remaining amount of ink, energy applied per unit time during execution of the preliminary discharge to the recording head is smaller as compared with energy applied per unit time when the remaining amount of ink is more than or equal to the predesignated remaining amount of ink.

* * * * *